United States Patent [19]

Schmolke

[11] Patent Number: 4,771,659

[45] Date of Patent: Sep. 20, 1988

[54] PROCESS FOR TREATING THE EDGES OF A SAW-TOOTH WIRE

[75] Inventor: Karl-Heinz Schmolke, Neuweiler, Fed. Rep. of Germany

[73] Assignee: Hollingsworth GmbH, Neubulach, Fed. Rep. of Germany

[21] Appl. No.: 921,565

[22] Filed: Oct. 21, 1986

[30] Foreign Application Priority Data

Nov. 7, 1985 [DE] Fed. Rep. of Germany ..... 3539464

[51] Int. Cl.[4] ..... B21K 23/00

[52] U.S. Cl. ..... 76/1; 76/101 R; 51/321

[58] Field of Search ..... 76/101 R, 112, 1; 51/321

[56] References Cited

U.S. PATENT DOCUMENTS 3,078,546 2/1963 Kiernan ..... 76/101 A
4,674,365 6/1987 Reed ..... 76/101 R

FOREIGN PATENT DOCUMENTS 2618060 11/1976 Fed. Rep. of Germany .
3332804 3/1985 Fed. Rep. of Germany .
414410 12/1966 Switzerland .

*Primary Examiner*—Roscoe V. Parker
*Attorney, Agent, or Firm*—Townsend & Townsend

[57] ABSTRACT

The saw-tooth wire for use in card clothings for textile machines is treated in a two step method to round off the edges of the front surfaces of the teeth. The edges are at first rounded off by use of a wet spraying agent containing an abrasive of a particle size of between 180 to 220 of international standard and thereafter are treated in a chemical finishing or deburring bath.

10 Claims, 1 Drawing Sheet

PROCESS FOR TREATING THE EDGES OF A SAW-TOOTH WIRE

BACKGROUND OF THE INVENTION

The invention relates to a process for treating the edges of a saw-tooth wire for clothings in textile machines and to an apparatus for carrying out the method.

It is already known to use saw-tooth wire clothings the teeth of which are rounded off, in order to achieve a better carding performance and to avoid clogging of the clothing.

In a known process, the rounding off is achieved by means of chemical or electrochemical deburring (DE-OS No. 33 32 804). However, the duration of the treatment proved to be very critical. If the treatment was extended over too long a period, the edges of the teeth developed so-called snowdrifts or knobbles, i.e. lateral projections on the teeth. Such disadvantageous surface irregularities occurred especially when the saw-tooth wire had been tempered prior to the chemical treatment, for instance by hardening and annealing. However, tempered saw-tooth wires call for a longer treatment, which in turn aggravates the aforementioned phenomenon.

It has been tried to reduce the duration of the treatment by adding certain salts such as those containing ammonium fluoride or producing hydrogen peroxide, which, however, resulted in the occurrence of pits, particularly in the area of the base of the teeth, but also on the side faces of the same.

BRIEF SUMMARY OF THE INVENTION

It is an object of the invention to conceive a process for treating the edges of a saw-tooth wire, in which the front edges of the teeth may be rounded off to a desired or required radius of curvature without the occurrence of surface faults.

This and other objects are achieved by at first rounding off the front edges of the teeth by wet spraying, and thereafter treating the saw-tooth wire in a chemical deburring bath. By this, the chemical deburring needs not be applied for a long period of time, since burrs are no longer present, but serves only as an additional step in improving the surface structure or condition of the teeth.

Applicant has found that a so-treated saw-tooth wire, when used as a card clothing in textile machines, has a carding performance that is practically constant over the whole life span of the saw-tooth wire.

Preferably, an aqueous suspension of an abrasive is used for wet spraying, in particular aluminium oxide powder of a particle size of between 180 and 220 (according to international norm) and the rounding off of the front edges of the teeth should be carried out for the most part by wet spraying. Thus, an optimum performance of the saw-tooth wire for use as a card clothing is achieved.

The apparatus of the invention for carrying out the process comprises a drum, onto which the saw-tooth wire is rolled up and which is movable axially and radially with respect to at least one nozzle of a wet spraying device. In such an apparatus, the saw-tooth wire is moved helically beneath the nozzle, and thus, the jet of the wet spraying agent emanating from the nozzle may be adjusted to impinge on the front edges of the teeth and to remain invariable in its relative position to the saw-tooth wire.

The nozzles may be arranged in pairs and at both sides of the saw-tooth wire at an angle to a diameter plane of the drum.

BRIEF DESCRIPTION OF THE DRAWINGS

The invention will now be described in more detail with reference to the accompanying drawings, in which.

DETAILED DESCRIPTION OF A PREFERRED EMBODIMENT

Figure 3:
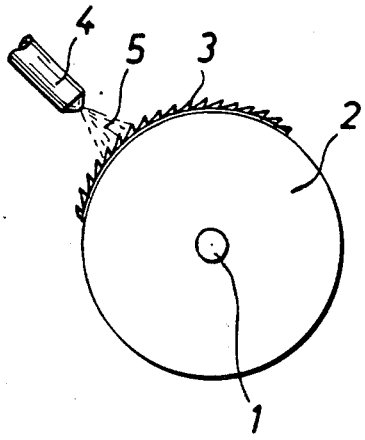
FIG. 3 is a side elevational view of an apparatus for treating the saw-tooth wire.
Figure 4:
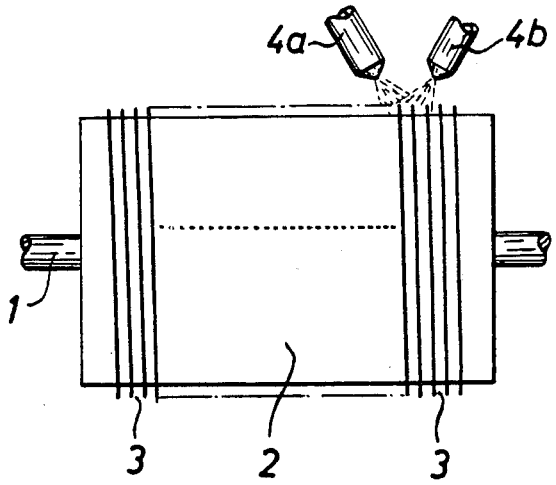
FIG. 4 is a top view of the apparatus.

To carry out the process according to the invention, a device is used as shown in FIGS. 3 and 4. Such a device comprises a drum 2, rotatable on a shaft 1. The saw-tooth wire 3 to be treated is helically wound on the cylindrical surface of the drum and the ends of the saw-tooth wire are clamped or screwed to the drum.

At least one nozzle 4 (FIG. 3) of a wet spraying station is positioned at a short distance from the saw-tooth wire and such, that the spraying agent 5 emanating from the nozzle is directed towards the teeth of the saw-tooth wire.

The clearance between the nozzle 4 and the saw-tooth wire 3 is best determined by experiments, since it depends on various parameters, and is generally between 1 and 10 cm. An aqueous suspension of aluminium oxide powder of a particle size of between 180 and 220 (according to international norm) is used as a spraying agent. The agent is fed to the nozzle under a pressure of generally between 3 and 10 bars (kg/cm$^2$).

Several nozzles may be provided in order to reduce the processing time, for instance in pairs 4*a* and 4*b* (FIG. 4), and at an angle with respect to the saw-tooth wire, as shown in FIG. 4, so that the wet spraying agent is directed towards the front surface 6 of the teeth. The drum 2 is rotatable, and the nozzles 4 may be moved axially with respect to the drum 2 in a coordinated movement, so that the relative position of the nozzles 4*a*, 4*b* with respect to the side faces of the saw-tooth wire is invariable. In other words, nozzles 4*a*, 4*b* are moved like a nut on threads provided by the saw-tooth-wire 3.

In an alternate embodiment, instead of a single pair of nozzles 4*a*, 4*b* as shown in FIG. 4, a higher number of nozzles may be used in order to further reduce the processing time.

In performing the process of the invention, the saw-tooth wire is wound helically onto the surface of the drum 2 with adjacent turns abutting or contacting each other. The ends of the saw-tooth wire are screwed to the drum. The so-prepared drum 2 is rotated at a constant speed, and nozzle 4 (in FIG. 3) or 4*a* and 4*b* (in FIG. 4) are moved at a constant speed parallel to the axis of the shaft 1. The movement may be set so that the front edges of the teeth have been rounded off by the required amount after one pass of the wire below the spray nozzles. However, the movement may be alternatively performed backwards and forwards in a reciprocating movement.

The best results in carding will be achieved when the rounding off of the front surface 6 of the teeth of the saw-tooth wire 3 is mainly effected by wet spraying. Experiments have shown that with a width of the teeth of 1 mm and a maximum rounding off radius of the edges of the front surface the wet spraying should be continued at least until the edges have a radius of curvature greater than 0.25 mm. However, it should be noted that the radius of curvature preferably should be choosen still higher.

In a second step of the process the saw-tooth wire is placed in a deburring bath for the final treatment. Such a bath, however, rather serves for further rounding off the edges and/or finishing the surface of the teeth instead of deburring. This second step of the process may be carried out in accordance with the process as described in DE-OS No. 33 32 804.8.

The wet spraying treatment is carried out for a period of between 10 to 20 minutes at a water pressure of 3 bars, and treatment in a chemical bath of a chemical deburring solution, for instance a bath sold under the trade name "Achat" of the Metallglanz Company of Mühlacker near Pforzheim or "Karbochem" of the Poligrat Company of Munich is carried out for a period between 2 and 5 minutes.

Figure 1:
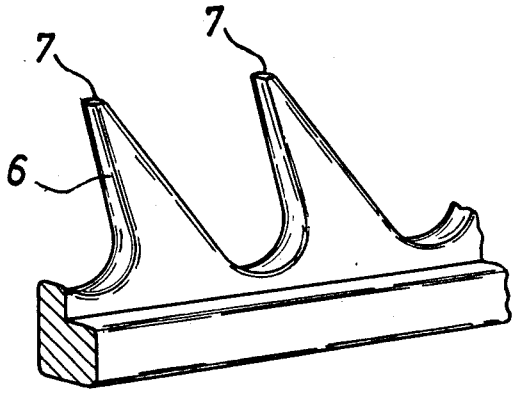
FIG. 1 is a perspective view of a section of a saw-tooth wire treated according to the invention.

The thus treated saw-tooth wire shown in FIG. 1 has evenly rounded edges of the front surface 6 and no irregularities in the surface structure. The tips 7 of the teeth, which still have sharp edges, should also be treated such that they are rounded off (not illustrated). To this end, the wet spraying agent is not only directed onto the front edges, but also on the tips of the teeth.

Figure 2:
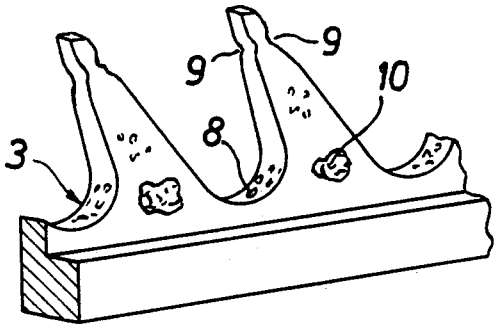
Fig.2 PRIOR ART
FIG. 2 is a saw-tooth wire treated according to a known process.

FIG. 2 shows a saw-tooth wire section which has only been treated chemically. At the bottom of the teeth and at the side faces small pits are present, which are approximately 0.1 mm in depth and diameter. Furthermore, a reduction in the cross section area 9 near the tips of the teeth may occur as well as knobbles 10 or so-called snowdrifts on the side faces of the teeth.

Alternatively, nozzles 4 may be fixed and the shaft 1 may by threaded, so that when rotating the drum 2 it concurrently performs an axial movement, so that the teeth of the saw-tooth wire pass beneath the jet or jets of the abrasive suspension emanating from the nozzles 4, 4*a*, 4*b*.

I claim:

1. A process for treating the edges of a saw-tooth wire for clothing in textile machines including the steps of rounding off front edges of the teeth of the saw-tooth wire by:

(a) wet spraying; and (b) treating the edges in a chemical deburring bath.

2. The process as defined by claim 1 wherein the step of rounding by wet spraying includes the use of an aqueous suspension of an abrasive.

3. The process as defined by claim 2 wherein the use of an abrasive includes the use of aluminum oxide powder.

4. The process as defined by claim 3 wherein the use of aluminum oxide powder includes use of a particle size between 180 and 220 (international norm).

5. The process as defined by claim 10 wherein the step of wet spraying substantially completes the step of rounding off.

6. The process as defined by claim 1 wherein the step of wet spraying is performed for a period of between 10 and 20 minutes at a pressure of between 10 and 3 bars.

7. The process as defined by claim 6 wherein the step of treating is performed for a period of between 2 and 5 minutes.

8. An apparatus for rounding the edges of a saw-tooth wire comprising:

a rotatable drum;

a wet spraying device including at least one nozzle for directing a spray of aqueous suspension towards the drum; and means for permitting relative axial and radial movement between the nozzle and the drum, whereby a saw-toothed wire is rolled on the drum such that the edges of the wire are thereby rounded.

9. The apparatus as defined by claim 8 further comprising a plurality of nozzles arranged in pairs at an angle with respect to a diameter plane of said drum.

10. The apparatus as defined by claim 8, further comprising a dipping bath containing a chemical deburring solution.

* * * * *